US008632860B2

(12) United States Patent
Shahidi et al.

(10) Patent No.: US 8,632,860 B2
(45) Date of Patent: Jan. 21, 2014

(54) METHOD OF PREPARATION OF MULTIFUNCTIONAL TECHNICAL TEXTILE BY PLASMA-TREATMENT

(76) Inventors: Sheila Shahidi, Arak (IR); Mahmood Ghoranneviss, Tehran (IR)

( * ) Notice: Subject to any disclaimer, the term of this patent is extended or adjusted under 35 U.S.C. 154(b) by 83 days.

(21) Appl. No.: 13/287,447

(22) Filed: Nov. 2, 2011

(65) Prior Publication Data

US 2013/0108805 A1 May 2, 2013

(51) Int. Cl.
*H05H 1/24* (2006.01)
*B05D 1/12* (2006.01)

(52) U.S. Cl.
USPC ..... 427/576; 427/191; 427/192

(58) Field of Classification Search
USPC ..... 427/534, 535, 576, 191, 192
See application file for complete search history.

(56) References Cited

U.S. PATENT DOCUMENTS

| | | | | |
|---|---|---|---|---|
| 3,853,657 | A * | 12/1974 | Lawton | 156/180 |
| 4,041,261 | A * | 8/1977 | Rich | 218/126 |
| 5,112,462 | A * | 5/1992 | Swisher | 205/165 |
| 5,972,160 | A * | 10/1999 | Straemke | 156/345.43 |
| 6,187,391 | B1 * | 2/2001 | Kataoka et al. | 427/569 |
| 2003/0134558 | A1 * | 7/2003 | Lien et al. | 442/377 |
| 2004/0224100 | A1 * | 11/2004 | Severich et al. | 427/535 |
| 2005/0042869 | A1 * | 2/2005 | Ohmi et al. | 438/689 |
| 2005/0205574 | A1 * | 9/2005 | Lambotte et al. | 220/234 |
| 2006/0021150 | A1 * | 2/2006 | Hu et al. | 8/115.51 |
| 2007/0161308 | A1 * | 7/2007 | Bourham et al. | 442/123 |
| 2008/0107822 | A1 * | 5/2008 | Selwyn et al. | 427/535 |
| 2008/0226928 | A1 * | 9/2008 | Tanaka et al. | 428/446 |
| 2009/0155490 | A1 * | 6/2009 | Bicker et al. | 427/576 |
| 2009/0202817 | A1 * | 8/2009 | Durandeau et al. | 428/332 |
| 2009/0252861 | A1 * | 10/2009 | Tessier et al. | 427/2.31 |
| 2010/0101696 | A1 * | 4/2010 | Agresti et al. | 152/451 |
| 2010/0173167 | A1 * | 7/2010 | Vissing et al. | 428/447 |
| 2010/0196620 | A1 * | 8/2010 | Eberhardt et al. | 427/535 |
| 2010/0203257 | A1 * | 8/2010 | Simor et al. | 427/491 |
| 2011/0070793 | A1 * | 3/2011 | Hales et al. | 442/76 |

FOREIGN PATENT DOCUMENTS

DE 102006042635 A1 * 3/2008

OTHER PUBLICATIONS

Hocker, Hartwig, "Plasma treatment of textile fibers". Pure Appl. Chem., vol. 74, No. 3, pp. 423-427, 2002.*
Jhala, P.B., "Plasma Processing for High End Technical Textiles". Textile Review, Aug. 2010, Abstract Only.*
Desai, Anita, A., et al., "Plasma technology: A review." The Indian Textile Journal, Jan. 2008, pp. 1-11.*
Sparavigna, Amelia, "Plasma treatment advantages for textiles". Cornell University Library. arXiv:0801.3737v1 [physics.pop-ph], pp. 1-16.*

* cited by examiner

*Primary Examiner* — Bret Chen
(74) *Attorney, Agent, or Firm* — Barry Choobin; Patent 360 LLC

(57) ABSTRACT

Disclosed is a method for preparing a multifunctional technical textile that exhibits multiple functional properties comprising flame or fire-retardancy, EMI shielding, anti-odorous property, UV protection, oil-repellency, anti-soiling property, antimicrobial property, anti-creasing property, water-proof, and antistatic property. The method comprises washing a textile product in a water solution comprising water mixed with a predetermined quantity of non-ionic detergent, storing the textile product at a predetermined temperature and a predetermined relative humidity, and subjecting the textile product to plasma treatment by placing the same in a plasma stream within a reaction chamber.

20 Claims, 1 Drawing Sheet

METHOD OF PREPARATION OF MULTIFUNCTIONAL TECHNICAL TEXTILE BY PLASMA-TREATMENT

FIELD OF THE INVENTION

The present invention relates to various treatments of textiles, more particularly to plasma-treatments of textiles, and even more particularly to a plasma-treatment method for obtaining multifunctional technical textiles.

BACKGROUND OF THE INVENTION

Technical textiles are a specialized textile product used primarily for their function rather than for their aesthetic purposes. Some of the functions of the technical textiles are EMI shielding, water-proofing, fire and flame resistance, antistatic function, antimicrobial function, fire-resistance, and anti-odor function. The clothing made from the technical textiles is commonly referred to as protective clothing, which is used for various applications. For example, the protective clothing with an antistatic property or characteristic is used by the operators of a gas station, firefighters, and the like, as such clothing prevents the accumulation of electric charges on the surface thereof. Protective clothing with antimicrobial function is another product of technical textiles which helps in preventing the cross-transmission of infectious diseases, and is therefore used in hospitals, medical laboratories, and so on. Yet another example would be fire-resistant clothing typically worn by firefighters while performing firefighting operations.

In spite of various types of protective clothing known in the prior art, there's still a need for technical textiles that exhibit more than one function. For example, a protective clothing used in medical facilities might need to be water-proof while being anti-microbial. Similarly, another example would be a sportswear which needs to have an anti-odor function while exhibiting an anti-UV property. Several attempts have been made in the art to address the need for multifunctional technical textiles, however, the multifunctional textiles made out of these attempts comprises more than one layer of cloth and is therefore bulky and heavy causing inconvenience to the wearer. Therefore, there exists a need for a multifunctional technical textile which is light and single or uni-layered.

Further, the technical textiles are typically manufactured by a multi-stage wet process which consumes a lot of time. And on top of that, these wet processes are not eco-friendly as they produce a lot of wastewater which is hazardous to the environment. Hence, it is desirable to manufacture light, single-layered, multifunctional technical textiles from a dry, quick, eco-friendly method.

SUMMARY OF THE INVENTION

It is a primary object of the present invention to provide a method of treatment of textiles in order to obtain light, single-layered multifunctional technical textiles.

It is another object of the present invention to provide such a method of treatment which is dry and eco-friendly.

It is yet another object of the present invention to provide such a method of treatment which is a single-stage process.

It is still yet another objective of the present invention to provide such a method of treatment which is less time-consuming compared to conventional methods that are employed for obtaining technical textiles.

It should also be understood that many other advantages and alternatives for practicing the invention will become apparent from the following detailed description of the preferred embodiments and the appended drawings.

BRIEF DESCRIPTIONS OF THE DRAWINGS

FIGURES—REFERENCE NUMERALS

10 . . . Reaction Chamber for Low-Pressure Plasma Treatment
12 . . . Anode
14 . . . Cathode
16 . . . Guide Roll
18 . . . Reaction Chamber for Atmospheric-Pressure Plasma Treatment
20 . . . Electrode
22 . . . Trolley
24 . . . Textile Product
26 . . . Precursor Material

DETAILED DESCRIPTION OF THE INVENTION

The present invention is a method of treatment of textiles with plasma for obtaining multifunctional technical textiles. The method of plasma-treatment of the present invention is clean, dry and eco-friendly as it doesn't involve treatment with chemicals, liquids including water. Also, the plasma-treatment method is a single-stage method and is therefore less time-consuming compared to the treatments directed to the same end as the plasma-treatment method of the present invention. In fact, the time required for the completion of the method of plasma-treatment of the present invention does not exceed five minutes. The final product of the plasma-treatment method is a multifunctional textile is a technical textile that is single-layered and exhibits more than one property or characteristic. Multifunctional textile so obtained, similar to a conventional technical textile, is used in various fields of application. For example, the multifunctional textile can be used as a medical textile as the multifunctional textile is both water-proof and antimicrobial. Similarly, the multifunctional textile can be used as a sportswear as exhibits both odor-free and anti-UV characteristics.

Prior to the initiation of the plasma-treatment method of the present invention, a textile product is washed in a solution comprising water mixed with non-ionic detergent water following the ratio of 1 gram per liter of water. More particularly, the textile product is washed at 40° C. for 10 minutes. Once washed, the textile product is stored at 20° C. and at 65% relative humidity. The textile product, such as a cloth, may be woven, knitted, non-woven, and so on.

The plasma used for the present invention can pertain to inert gases, particularly argon, or to reactive gases such as oxygen, nitrogen or nitrogen containing polymeric gases, and so on, with nitrogen plasma being preferable. Both low-pressure and atmospheric pressure plasma discharges can be used for the plasma-treatment. It is to be noted that the gases used for the plasma-treatment are pure grade.

Figure 1:
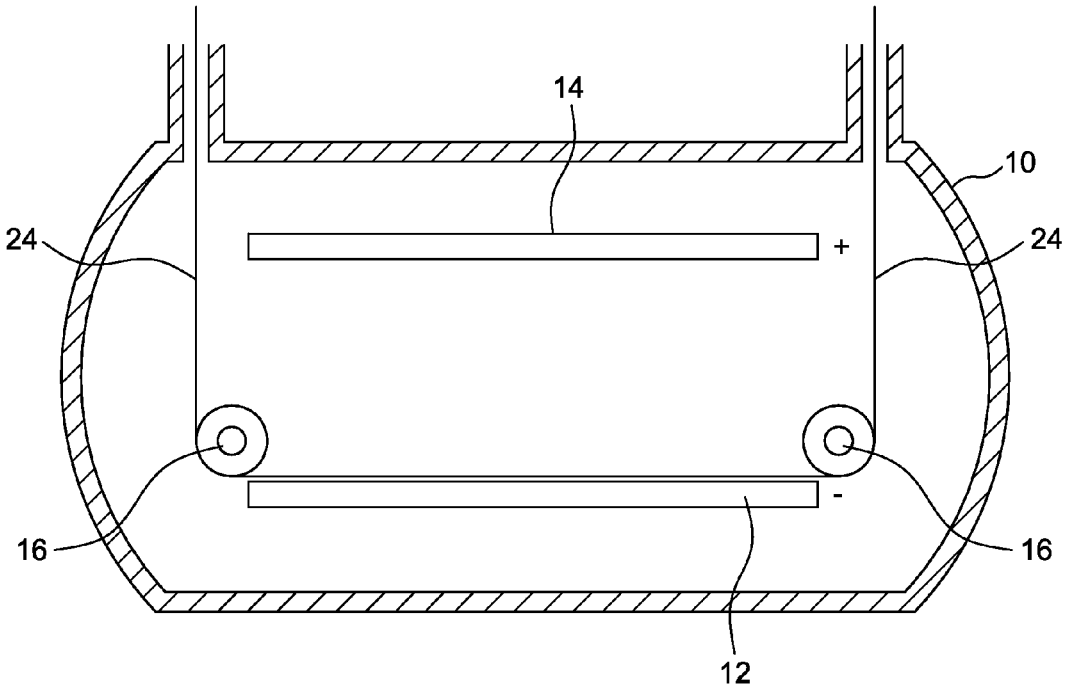
FIG. 1 is an illustration of the reaction chamber employed for low-pressure plasma treatment of the textile product in accordance with the present invention.

Referring to FIG. 1, for the low-pressure plasma treatment, a cylindrical reaction chamber 10 made of glass is employed for generating the low-pressure plasma from a gas. A rotary pump is employed for evacuating the reaction chamber 10 before filling up the same with a gas from which plasma is generated. The gas within the reaction chamber 10, which is preferably nitrogen, is maintained at a pressure of $10^{-2}$ Torr. The reaction chamber 10 further comprises a pair of electrodes, viz., an anode 12 and a cathode 14 wherein, when the electrodes are powered, a glow discharge is radially produced between the same. The gas between the electrodes is subjected to electromagnetic force resulting in the generation of plasma. An axial magnetic field formed within the reaction chamber 10 ensures uniform distribution of the plasma medium. The textile product 24 is placed on the anode 12 so as to be exposed to the plasma. In one embodiment, the reaction chamber 10 comprises a plurality of guide rolls 16 whereon the textile product 24 is transported in and out of the reaction chamber 10. The surface of the textile product 24 reacts with the plasma so as become a multifunctional textile.

In one embodiment, argon plasma is used in the reaction chamber instead of nitrogen plasma. In this case, metallic particles are attached to the surface electrodes, whereby, upon the initiation of the plasma-treatment, the metallic particles are sputtered over the surface of the textile product forming a nano-layer of the metallic particles thereon. The antimicrobial property of the multifunctional textile is substantially increased with the deposition of metallic particles. The thickness of the nano-layer of the metallic nanoparticles depends on the electrodes, their shape and size, voltage supplied to the electrodes, and so on. In another embodiment, copper, silver, gold, and titanium are used as electrodes, which also enhance the antimicrobial properties of the multifunctional textile.

Figure 2:
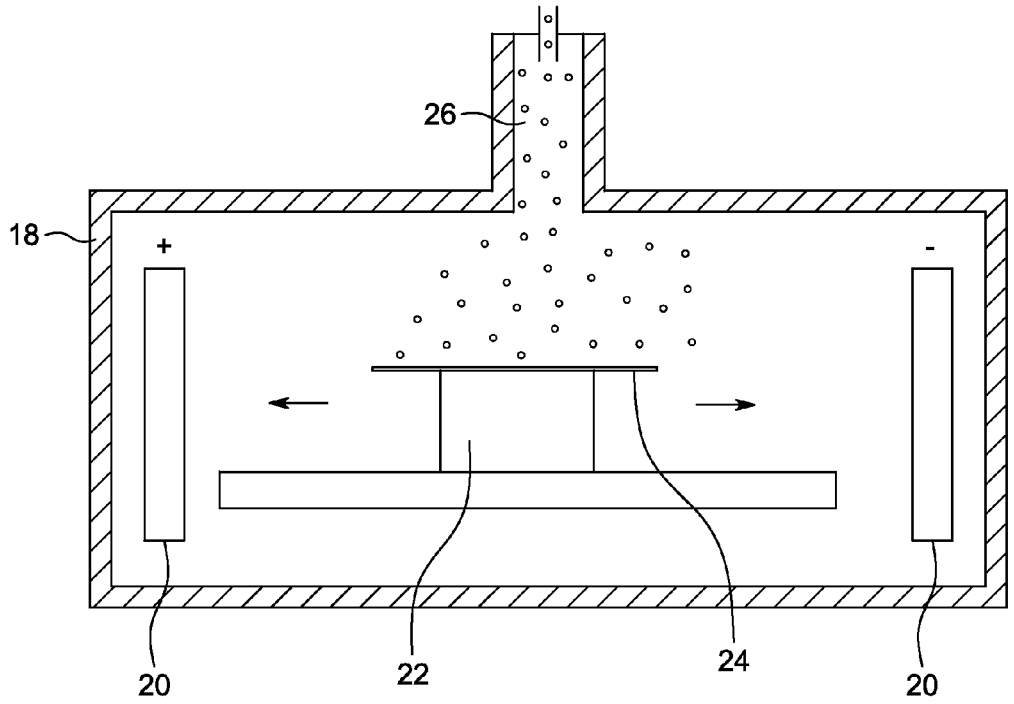
FIG. 2 is an illustration of the reaction chamber employed for atmospheric-pressure plasma treatment of the textile product in accordance with the present invention.

Referring to FIG. 2, the reaction chamber 18 comprises a high power supply unit when atmospheric-pressure plasma is used in for the plasma-treatment of the textile product 24. The reaction chamber 18 is set to operate at 300 W. The electrodes 20 employed within the reaction chamber 18 are made of ceramic containing aluminum oxide ($Al_2O_3$) essentially. An alternating current of 20 kV is supplied to the electrodes 20, as a result of which, a substantial amount of heat is generated by the electrodes 20 during the course of the plasma-treatment. An oil circulation system operated by a pump is employed for cooling the electrodes 20 at regular intervals in order to help prevent the same from overheating.

The distance between the electrodes 20 is adjustable within a range of 0.5 to 2.5 mm. Nitrogen is preferable although air and other gases including oxygen, argon can also be used for generating plasma. The reaction chamber 18 further comprises a trolley 22 whereon the textile product 24 is placed for uniform plasma exposure. More particularly, a vacuum sucker is employed for holding the textile product 24 in place as the trolley 22 imparts linear movement to the textile product. In one embodiment, a plurality of guide rolls is employed instead of the trolley 22 for transporting the textile product through the reaction chamber 18.

Apart from the plasma produced from the ceramic electrodes 20, a precursor material 26 is discharged into the plasma medium. The state of matter of the precursor material 26 may be liquid or powered. The precursor material 26 is atomized as the same is released into the plasma thereby enabling precursor material 26 to uniformly mix with the plasma.

N—H groups are formed over the surface of the textile product as the same is subjected nitrogen plasma mixed with the precursor material. The N—H functional groups cause the textile product exhibit antimicrobial property, anti-creasing property, anti-soiling property, UV protective property, and so on. The Limited Oxygen Index (LOI) of the finished multifunctional textile is substantially more than that of the textile product and hence, the multifunctional textile is highly fire and flame-retardant. Also, the UV Protection Factor (UPF) of the finished multifunctional textile is nearly 2000 thus making it highly protective against UV radiation. The multifunctional textile can be used for filtering metals from wastewater. Compared to the input textile product, the dyeability of the finished multifunctional textile is substantially higher.

In both the cases of low-pressure plasma and atmospheric pressure plasma, the time of exposure of the plasma is not more than 5 minutes. However, the exposure time may vary depending on the plasma, the purity of gas, the textile product and its shape, and so on. The finished multifunctional textiles are antimicrobial, wrinkle-free, breathable, fire and flame-resistant, water-proof, UV-protective, dyeable, EMI shielding, oil repellant, and so on. The multifunctional textile exhibits anti-soiling function when the surface thereof is added with a layer of titanium oxide nanoparticles.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the invention with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall therebetween.

What is claimed is:

1. A method for preparing a multifunctional technical textile that exhibits multiple functional properties comprising flame or fire-retardancy, EMI shielding, anti-odorous property, UV protection, oil-repellancy, anti-soiling property, antimicrobial property, anti-creasing property, water-proof, and antistatic property, the method comprising the steps of: (a) washing a textile product in a water solution comprising water mixed with a predetermined quantity of non-ionic detergent; (b) storing the textile product at a predetermined temperature and a predetermined relative humidity; and (c) subjecting the textile product to plasma treatment by placing the same in a plasma medium within a reaction chamber, the plasma pertaining to a gas the chamber is filled with, the chamber comprising a pair of electrodes, viz., an anode and a cathode for generating the plasma, and wherein the plasma is used to deposit metallic particles and the metalic particles comes from cathode.

2. The method of claim 1, wherein the predetermined quantity comprises 1 gram/liter.

3. The method of claim 1, wherein the predetermined temperature and relative humidity are 20.degree. C. and 65% respectively.

4. The method of claim 1, wherein the gas comprises Nitrogen.

5. The method of claim 1, wherein the gas comprises an inert gas.

6. The method of claim 5, wherein the inert gas comprises Argon.

7. The method of claim 1, wherein the plasma comprises low-pressure plasma.

8. The method of claim 7, wherein the low-pressure plasma comprises a glow discharge plasma.

9. The method of claim 7, wherein the reaction chamber comprises a cylindrical glass chamber within which the low-pressure plasma is generated.

10. The method of claim 7, wherein the pressure of the gas within the chamber is maintained at 10.sup.-2 Torr.

11. The method of claim 7, wherein the electrodes are attached with metallic particles wherein, the metallic particles are deposited on a surface of the textile product as the metallic particles is being subjected to the plasma treatment.

12. The method of claim 11, wherein the electrodes within the chamber are made of ceramic essentially composed of A1.sub.2O.sub.3; the chamber within which the atmospheric-pressure plasma is disposed.

13. The method of claim 11, wherein the distance between the electrodes is adjustable within a predetermined range between 0.5 and 2.5 mm.

14. The method of claim 11, wherein the chamber is supplied with an alternating current of 200 milliamps.

15. The method of claim 11, wherein the chamber is supplied with a power of 300 watts.

16. The method of claim 11 further comprising the step of discharging a precursor material in the plasma while the textile product is being exposed thereto.

17. The method of claim 1, wherein the plasma comprises atmospheric-pressure plasma.

18. The method of claim 1, wherein the electrodes are made of a metal.

19. The method of claim 18, wherein the metal comprises Titanium.

20. The method of claim 18, wherein the metal comprises Copper.

* * * * *